US005296907A

United States Patent [19]

Kawabuchi et al.

[11] Patent Number: 5,296,907

[45] Date of Patent: Mar. 22, 1994

[54] IMAGE FORMING APPARATUS THAT PERMITS THE SETTING OF SEPARATED COPY MODES FOR AT LEAST ONE ORIGINAL DOCUMENT OF A PLURALITY OF ORIGINAL DOCUMENTS TO BE COPIED

[75] Inventors: Yoichi Kawabuchi; Masazumi Ito; Kazuhiro Araki; Toshiyuki Yamashita, all of Osaka, Japan

[73] Assignee: Minolta Camera Kabushiki Kaisha, Osaka, Japan

[21] Appl. No.: 905,143

[22] Filed: Jun. 23, 1992

Related U.S. Application Data

[63] Continuation of Ser. No. 551,029, Jul. 11, 1990, abandoned.

[30] Foreign Application Priority Data

Jul. 18, 1989 [JP] Japan ..... 1-185794

[51] Int. Cl.[5] ..... G03G 21/00

[52] U.S. Cl. ..... 355/313; 355/311; 355/326

[58] Field of Search ..... 355/203, 208, 245, 308, 355/311, 313, 314, 326, 327, 328; 118/645

[56] References Cited

U.S. PATENT DOCUMENTS

| | | | |
|---|---|---|---|
| 4,278,344 | 7/1981 | Sahay | 355/319 |
| 4,291,341 | 9/1981 | Yajima | 358/300 |
| 4,385,825 | 5/1983 | Kaneko | 355/319 |
| 4,537,497 | 8/1985 | Masuda | 355/313 |
| 4,592,651 | 6/1986 | Oikawa et al. | 355/72 |
| 4,657,376 | 4/1987 | Ide | 355/309 |
| 4,666,290 | 5/1987 | Yoshiura | 355/245 X |
| 4,743,945 | 5/1988 | Ito et al. | 355/244 |
| 4,763,161 | 8/1988 | Forest et al. | 355/207 |
| 4,803,521 | 2/1989 | Honda | 118/645 X |
| 4,845,526 | 7/1989 | Ito | 355/313 X |
| 4,864,350 | 9/1989 | Ishiguro et al. | 355/311 |
| 4,864,365 | 9/1989 | Ito | 355/311 X |
| 4,922,306 | 5/1990 | Araki et al. | 355/313 |
| 4,925,176 | 5/1990 | Acquaviva | 271/3.1 |
| 5,079,598 | 1/1992 | Kaneko et al. | 355/313 X |
| 5,113,221 | 5/1992 | Kotani et al. | 355/326 X |
| 5,117,265 | 5/1992 | Matsui et al. | 355/313 |

FOREIGN PATENT DOCUMENTS 62-11865 1/1987 Japan .

*Primary Examiner*—Benjamin R. Fuller
*Assistant Examiner*—J. E. Barlow, Jr.
*Attorney, Agent, or Firm*—Burns, Doane, Swecker & Mathis

[57] ABSTRACT

An image forming apparatus according to the invention includes a document transporting device for transporting a plurality of documents set on a tray one by one to a platen, copying mode selecting keys for selecting a first copying mode for forming images from the plurality of documents under first copying conditions and a second copying mode for forming an image from a particular one of the documents under second copying conditions, and a control device for executing the image forming operation under the copying conditions of the copy mode selected by the copy mode selecting key.

10 Claims, 19 Drawing Sheets

IMAGE FORMING APPARATUS THAT PERMITS THE SETTING OF SEPARATED COPY MODES FOR AT LEAST ONE ORIGINAL DOCUMENT OF A PLURALITY OF ORIGINAL DOCUMENTS TO BE COPIED

This application is a continuation of application Ser. No. 07/551,029, filed Jul. 11, 1990, now abandoned.

BACKGROUND OF THE INVENTION

1. Field of the Invention

The present invention relates to an image forming apparatus and particularly it relates to an image forming apparatus capable of forming an image from a document forming a cover in a mode different from one for other documents.

2. Description of the Related Art

A copying machine has been provided which comprises an automatic document feeder (ADF) adapted to have a series of documents set therein, and a document table onto which said documents are automatically fed for continuous copying operation.

In the above copying machine, in order to distinguish the final document (the document which is fed last onto the document table) from the other documents by regarding it as a document to be used as a cover, it is sometimes desired to copy the final document under copying conditions different from those for the other documents. In the case where a copying machine is to be provided with a mode for copying the final document under copying conditions different from those for the other documents (hereinafter referred to as the cover mode), the following points should be taken into consideration.

First, there is a demand for diversifying the cover mode for copying the cover document with a color different from that of the other documents.

Second, there is a demand for effecting the setting of the cover mode by simple keying.

Third, there is a demand for executing the copying operation for the cover mode on the basis of complete automation.

SUMMARY OF THE INVENTION

An object of the invention is to facilitate the use of an image forming apparatus.

Another object of the invention is to facilitate the setting of the cover mode in an image forming apparatus.

Another object of the invention is to automatically effect the image forming operation in the cover mode in an image forming apparatus.

To achieve these objects, an image forming apparatus according to the invention comprises document transport means for transporting a plurality of documents set on a tray to a platen one by one, copy mode selecting means for selecting either a first copy mode for forming images from a plurality of documents under first copy conditions or a second copy mode for forming an image from a particular one of said plurality of documents under second copy conditions, and control means for executing an image forming operation under the copy conditions of a copy mode selected by the copy mode selecting means.

The use of the image forming apparatus constructed as described above is improved in that desired image formation from a plurality of documents can be executed simply by selecting a corresponding copy mode.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

An embodiment of the invention will now be described in the order shown below:

<Description of Mechanism of Copying Machine>
<Description of Operating Panel>
<Description of Control Circuit>
<Description of Processing in CPU1>

<Description of Mechanism of Copying Machine>

Figure 1:
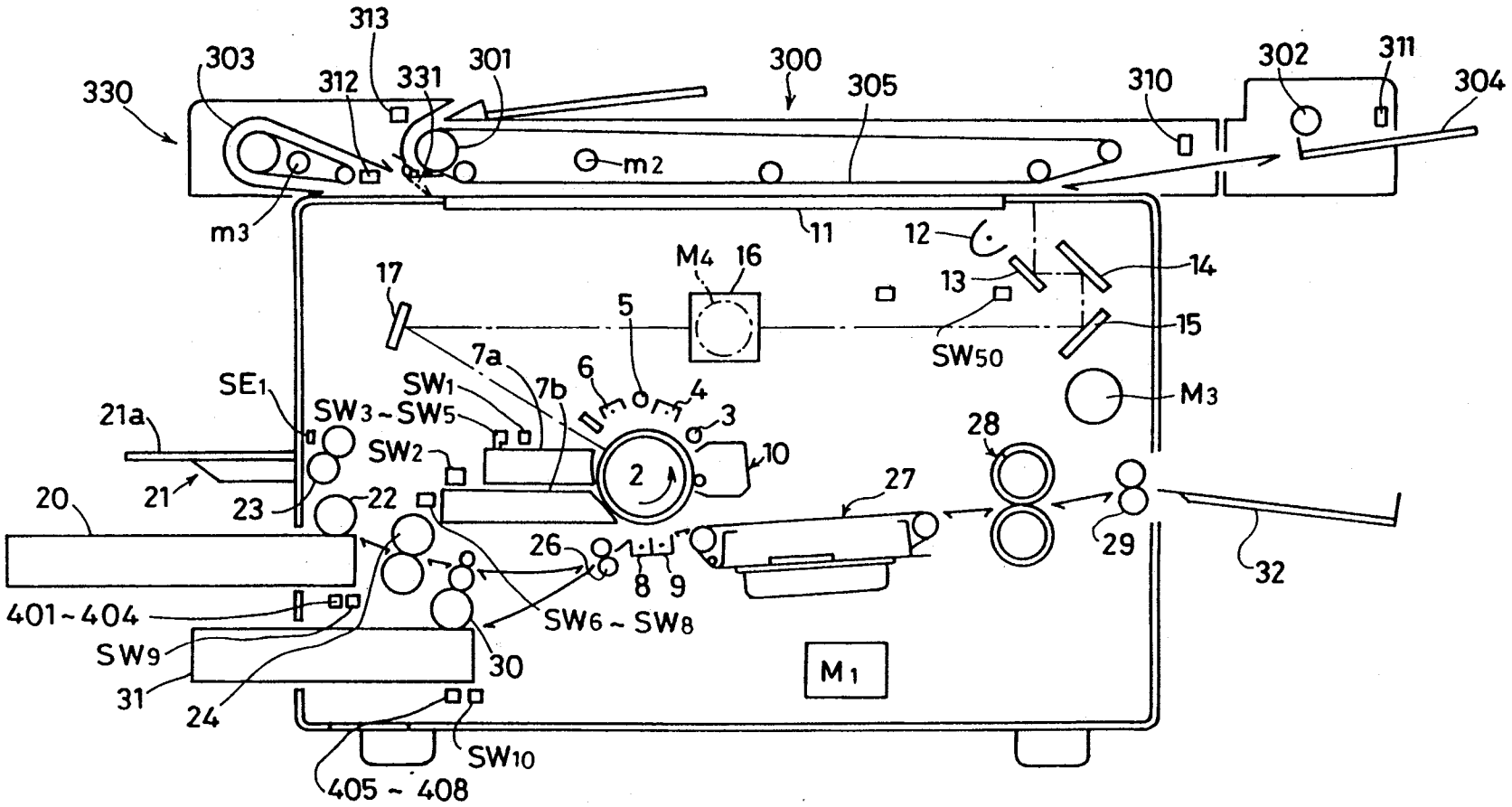
FIG. 1 is a schematic view showing the arrangement of a copying apparatus according to an embodiment of the invention.

FIG. 1 is a schematic view showing the mechanism of the present copying machine.

The copying machine shown is constructed with an automatic document feeder (ADF) 300 mounted on a document table 11.

(1) ADF 300

In the ADF 300, documents set with their intended faces downward on a document tray 304 are successively withdrawn by a paper feed roller 302 starting with the uppermost document. The document withdrawn is then transported to the document table 11 by a transport belt 305 and set on the document table 11, whereupon it is expose-wise scanned. Upon completion of exposure, it is discharged from the document table 11 by the transport belt 305.

The presence of a document on the document tray 304 is detected by a document detection sensor 311, while the feed of a document from the document tray 304 is detected by a document passage detection sensor 310. The discharge of a document is detected by a document discharge detection sensor 313.

A belt drive roller 301 drives the transport belt 305. A motor m2 drives the belt drive roller 301.

A reversing unit 330 reverses (or turns over) a document discharged from the document table 11 and feeds it back to the document table 11. The reversing unit 330 comprises a discharge destination switching lever 331, a document passage detection sensor 312, a document guide 303, and a belt drive motor m3.

(2) Copying Machine Body

The copying machine body comprises an optical system, an image forming system, and a paper processing system.

a) The optical system expose-wise scans a document set on the document table 11 by an exposure lamp 12 and forms a reflected-light image on the photoreceptor drum 2 of the image forming system successively through reflecting mirrors 13, 14, 15, a lens 16 and a reflecting mirror 17.

Scanning is effected by a first movable unit (having the lamp 12 and reflecting mirror 13 mounted thereon) and a second movable unit (having the reflecting mirrors 14 and 15 mounted thereon) traversing along the lower surface of the document table 11.

A motor M3 drives the first and second movable units, and a motor M4 corrects the lens position.

A sensor SW50 for detecting the positions of the first and second movable units is used to obtain a predetermined timing.

b) The image forming system is constructed using the photoreceptor drum 2 as the main component.

More particularly, disposed around the photoreceptor drum 2 rotatably supported on a shaft are eraser lamps 3 and 5 for removing residual charge, charges 4 and 6 for uniformly charging the photoreceptor drum 2, an upper developing unit *7a* for developing a latent image formed on the photoreceptor drum 2, a lower developing unit *7b*, a transfer charger 8 for transferring a toner image onto paper sheet, a copy separation charger 9 for separating a paper sheet from the photoreceptor drum 2, and a cleaner 10 for removing residual toner, in the order mentioned.

The setting of the upper developing unit *7a* at a predetermined position is detected by a switch SW1, and the setting of the lower developing unit at a predetermined position is detected by a switch SW2.

The color of a toner received in the upper developing unit *7a* is detected by switches SW3 through SW5, and the color of a toner received in the lower developing unit *7b* is detected by switches SW6 through SW8.

In addition, M1 denotes a main motor for driving the photoreceptor drum 2 and the like.

c) The copy paper processing system withdraws a paper sheet from a set paper feed port (a manual paper feed port, an upper paper feed port or a lower paper feed port) and delivers it between the transfer charger 8 and the photoreceptor drum 2 with the predetermined timing provided by the waiting of a timing roller pair 26. After a toner image has been transferred to the withdrawn paper sheet, the latter is fed to a fixing device through a transport belt 27. Thereafter, the fixed paper sheet is discharged onto the tray 32.

A manual paper feed tray 21 is installed in the manual paper feed port, and the setting of a paper sheet onto the manual paper feed tray 21 is detected by a paper sensor SEl. A number of paper sheets can be set in the manual paper feed port. The manual paper feed tray 21 is constructed so that it can be folded toward the copying machine body by the operator holding the front end 21*a* of the tray. A roller pair 23 withdraws a paper sheet from the manual paper feed port in response to a paper feed start signal.

A cassette 20 is set in the upper paper feed port. In the case where said cassette 20 is one for storing a copy paper sheet for a cover document, the upper paper feed port is constructed so that the switch SW9 is turned on. Sensors 401 through 404 detect the size of the paper sheets in the cassette 20. A withdrawing roller 22 withdraws paper sheets stored in the cassette 20. A withdrawn paper sheet is transported to a timing roller pair 26 by a transport roller pair 24.

A cassette 31 is set in the lower paper feed port. In the case where said cassette 31 is one for storing a copy paper sheet for a cover document, it is arranged that the switch SW10 is turned on. Sensors 405 through 408 detect the size of paper sheets in the cassette 31. A withdrawing roller 30 withdraws paper sheets received in the cassette 31.

<Description of the Operating Panel>

Figure 2:
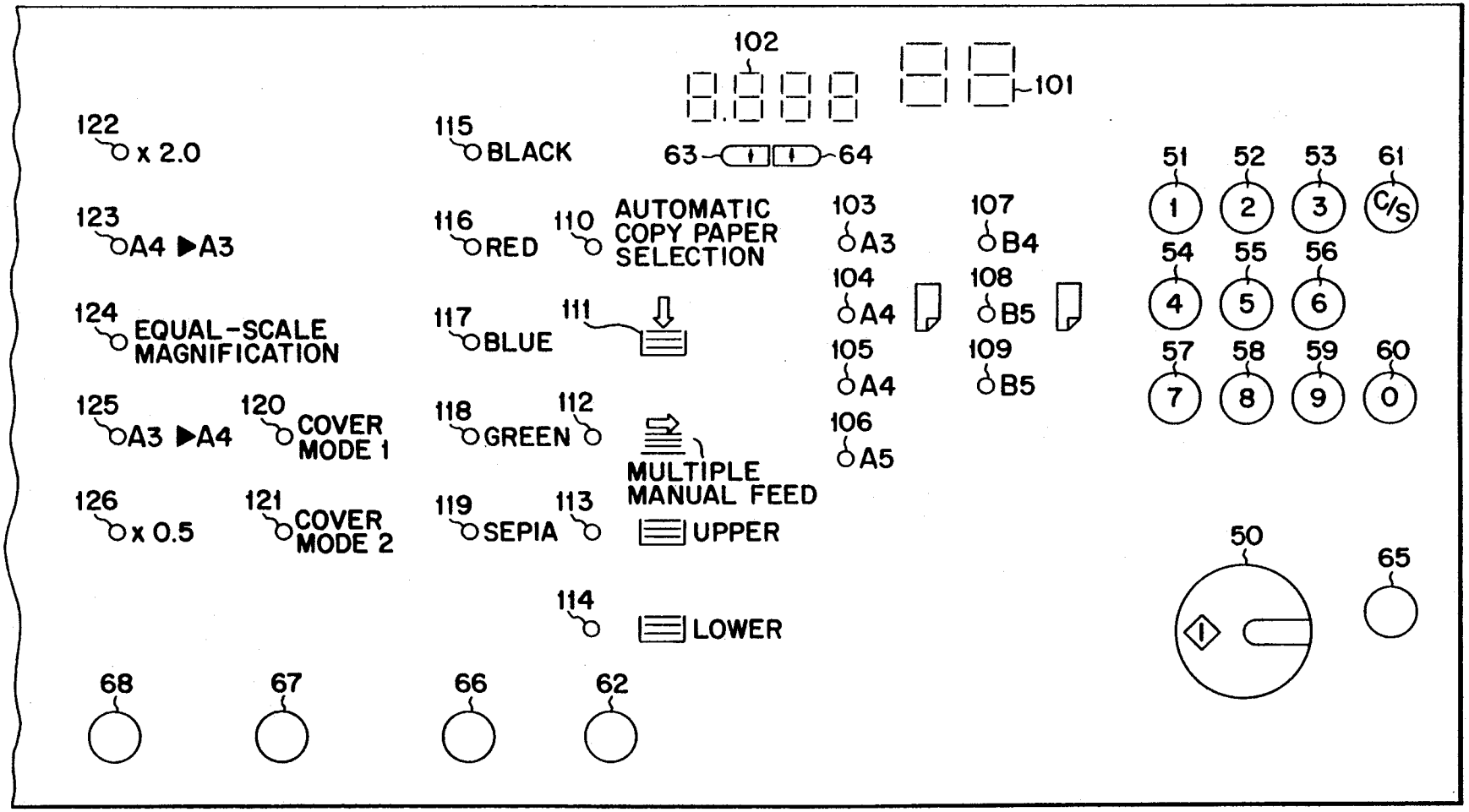
FIG. 2 is a view showing the contents of the operating panel of the copying apparatus of FIG. 1.

An operating panel shown in FIG. 2 is installed in the upper region (some distance from the document table 11) of the copying machine constructed in the manner described above.

Installed on the operating panel are switches and display elements enumerated below:

A start key 50 for giving a command for starting copying operation or document feed operation, ten-keys 51 through 60 for inputting numerical data, a clear/stop key 61 for giving a command for interrupting copying operation and clearing displaying element 101 for displaying in two digits the number of copies to be made for the same document, a reset key 65 for resetting a set mode, a magnification indicating element 102 for indicating copying magnification in four digits, size indicating LED elements 103 through 109 for indicating the size of paper sheets in a set paper feed port by lighting, a paper feed port selection key 62 for setting a paper feed port or automatic paper selection mode, an LED element 110 for indicating the automatic paper selection mode by lighting, an LED element 111 for indicating paper emptiness by lighting, LED elements 112 through 114 for displaying a set paper feed port by lighting, a color selection key 66 for selecting a toner color, LED elements 115 through 119 for indicating a selected toner color by lighting, a cover mode switching key 67 for giving a command for the setting, switching or cancelling of the cover mode, LED elements 120 and 121 for displaying the set cover mode by lighting, a magnification selection key 68 for selecting a copying magnification prepared in advance, and LED elements 122 through 126 for indicating a selected copying magnification by lighting.

<Description of Control Circuit>

Figure 3:
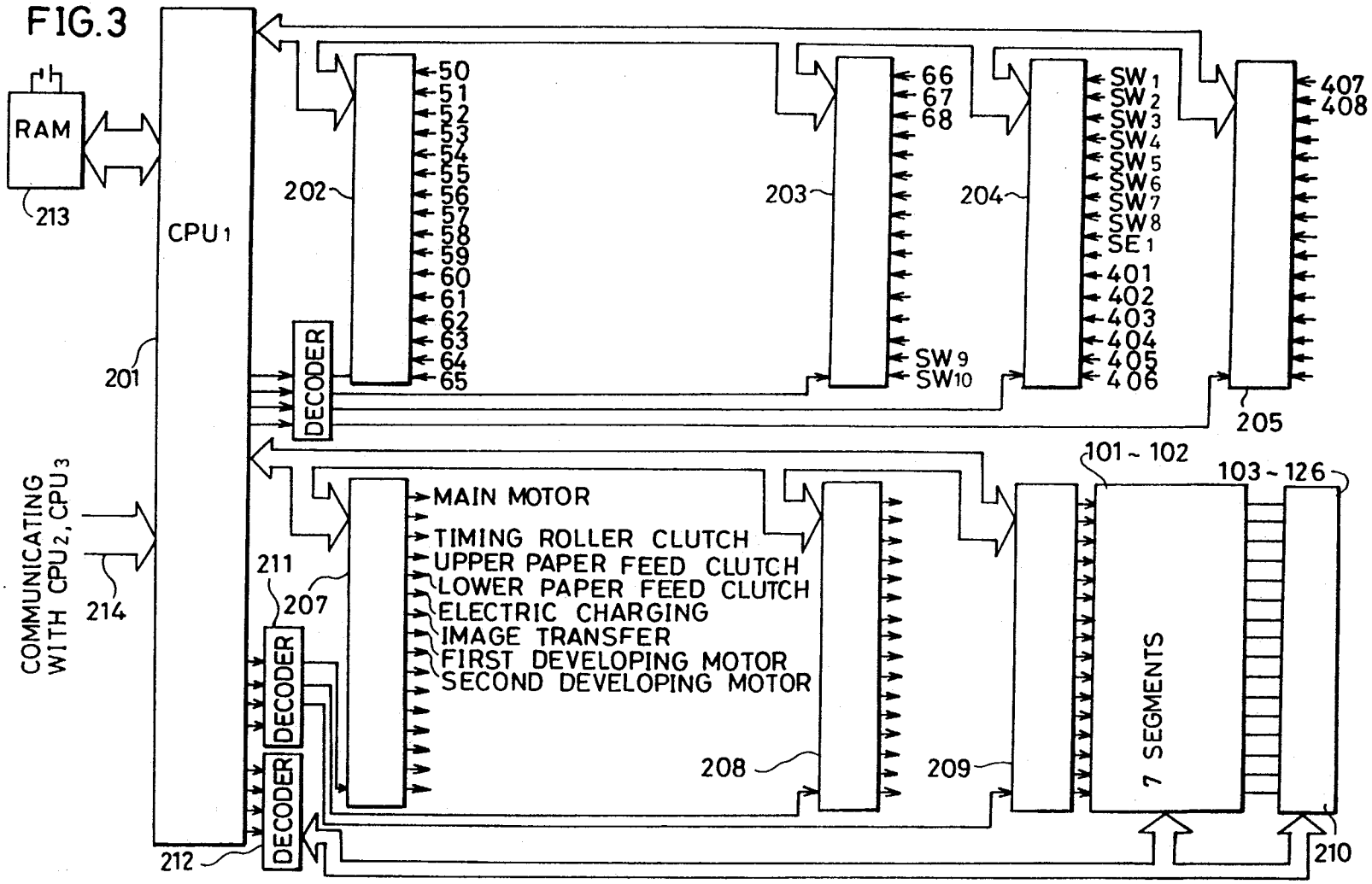
FIG. 3 is a block diagram showing the input/output arrangement of the control circuit of the copying apparatus of FIG. 1.

FIG. 3 is a block diagram showing the control circuit of the present copying machine.

As shown, the control circuit is constructed using as the main component the CPU1 (201) which controls the copying machine body. The CPU1 has connected thereto a CPU2 which controls the optical system and CPU3 which controls the ADF (see arrow 214).

Further, the CPU1 (201) is adapted to have inputted thereto through input developments ICs 202 through 205 signals from switches 50 through 63 disposed on said operating panel and siganls from sensors (SW1~SW10, 401 through 408) disposed in the machine body.

Signals are outputted from the CPU1 (201) through output developments ICs 207 through 210 on said operating panel to the display elements 101 through 126 on said operating panel and to actuators (including the first and second developing unit motors). In addition, these control signals are controlled by decoders 211 through 212.

A RAM 213 has data stored therein which are necessary for control operations described below.

<Description of Processing in CPU1 (201)>

The operation of the apparatus will now be described on the basis of the processing in CPU1 (201) which controls the copying machine body.

In addition, in the following description, "on-edge" refers a change of the state of a signal when it changes from "off" to "on".

(1) Main Routine

Figure 4:
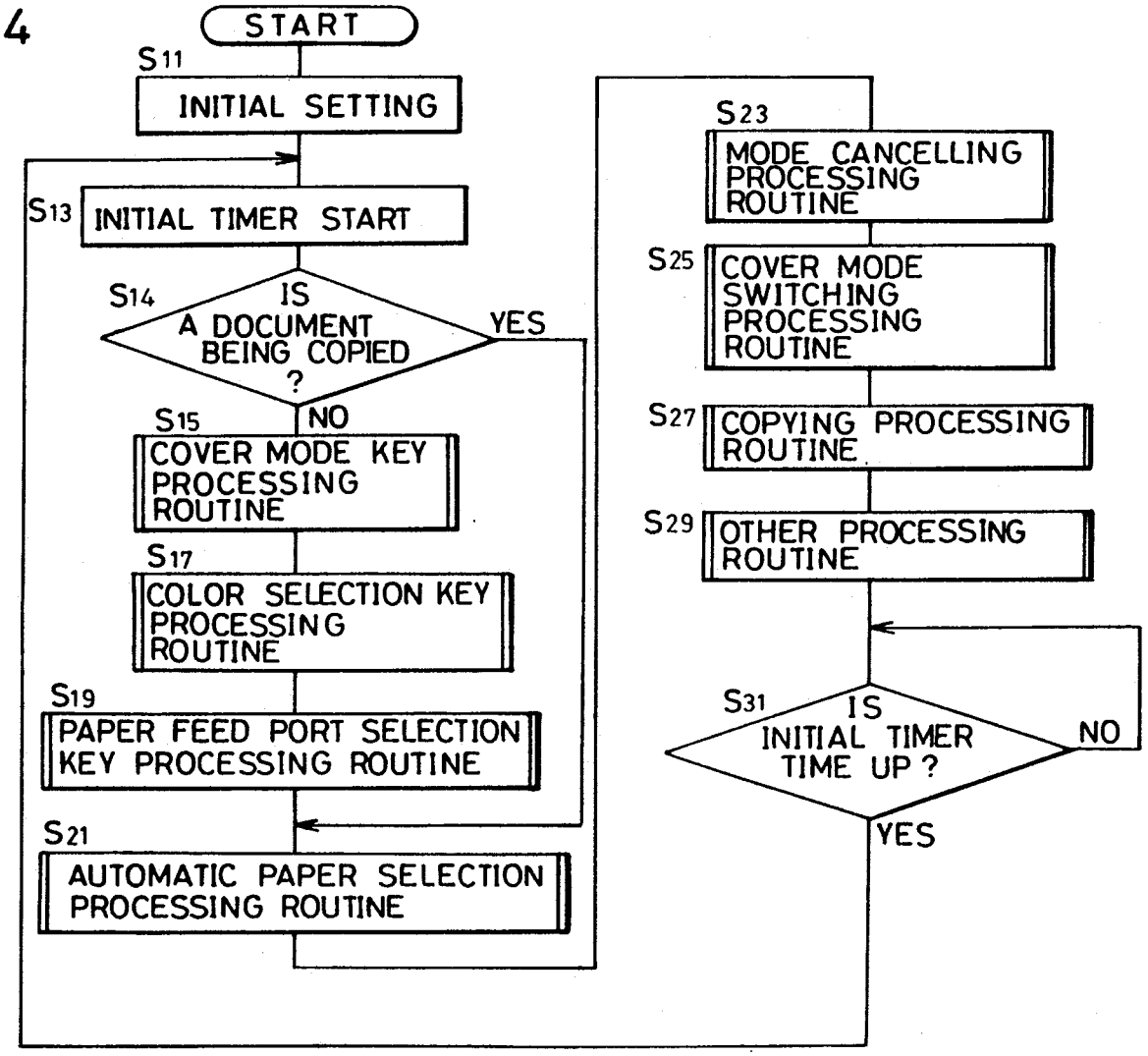
FIG. 4 is a flowchart showing a main routine for processing in a CPU controlling the copying apparatus of FIG. 1.

FIG. 4 is a flowchart showing the main routine for the processing in CPU1 (201).

The CPU1 (201) starts processing when the main switch is turned on, and then it sets initial conditions of the various devices, RAM, registers, and flags (S11).

Then an internal timer for specifying the time for 1 routine is set (S13).

Thereafter, the processing at the step S15 through S29 is executed and at the step S31 the CPU1 waits for the expiration of the period of time set by the internal timer and finally it is returned to the step S13; it repetitively executes such processing. In addition, the processing at the steps S15 through S19 is for inputting by keying and will not be executed if the copying process is not performed (S14; YES).

The processing to be executed at the steps S15 through S27 will be described below. In addition, the step S29 is one which collectively shows the processing except for the steps S15 through S27.

(2) Cover Mode Key Processing: S15

Figure 5A:
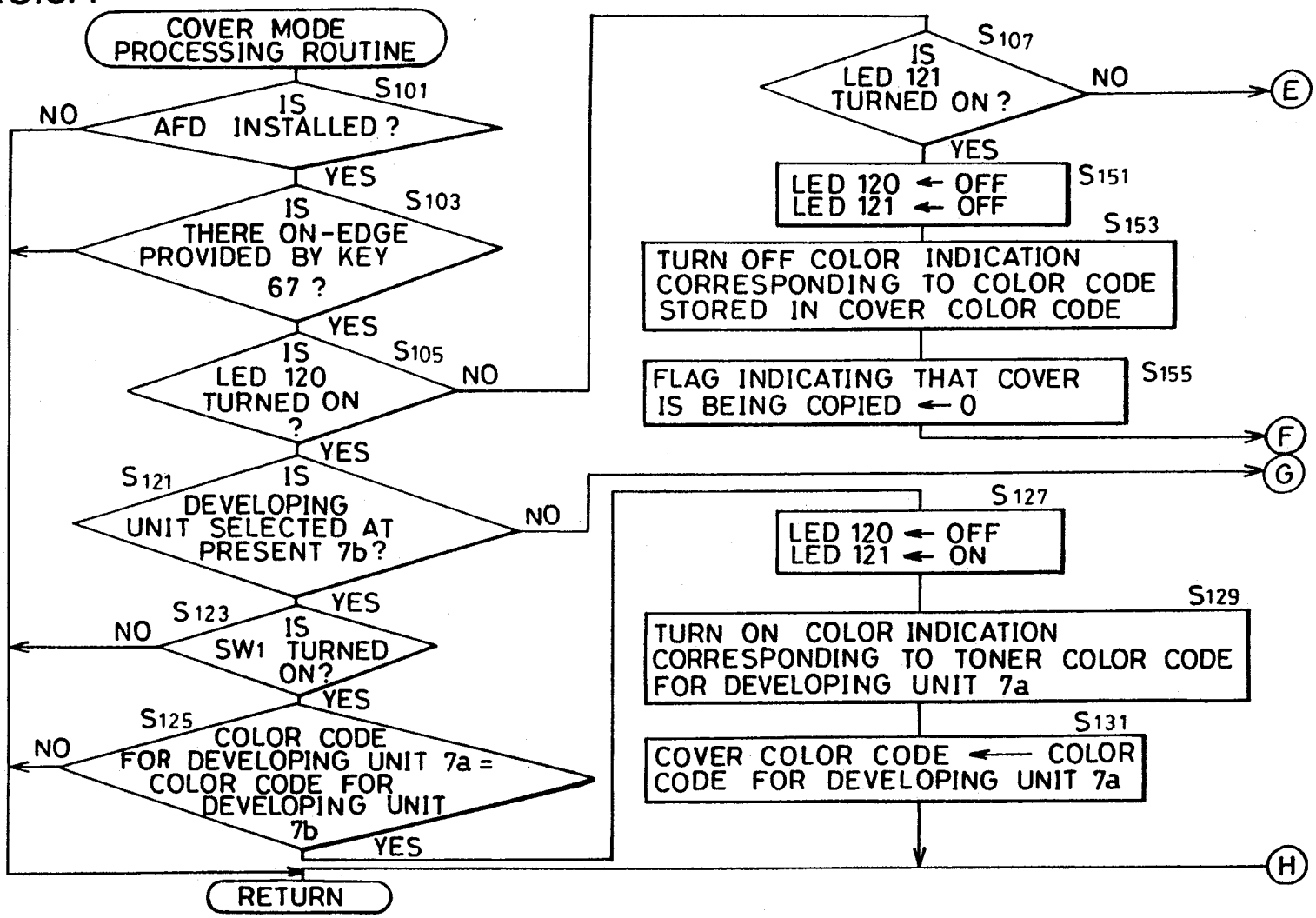
FIGS. 5A and 5B are flowcharts showing the contents of a cover mode key processing routine in FIG. 4.
Figure 5B:
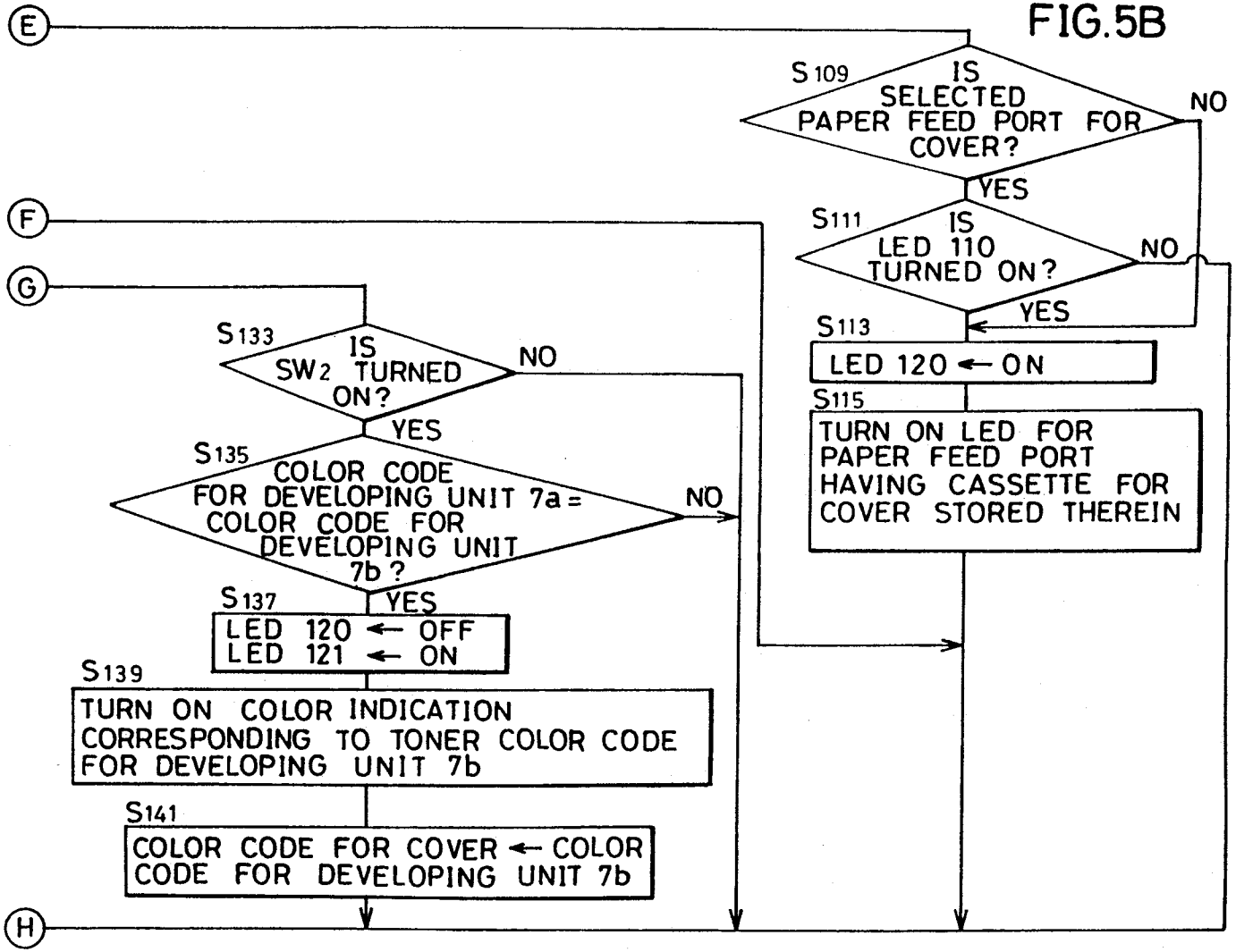

FIGS. 5A and 5B are flowcharts showing processing at the step S15.

In this processing, in response to on-edge provided by the cover mode key 67 (S103; NO), the setting of the cover mode is effected normally on a rotation basis. However, in the case where the ADF 300 is not mounted on the present copying machine (S101; NO), the detection of the cover document (the last document) cannot be made; thus, this processing will be executed.

<i> Setting of Cover Mode

When on-edge provided by the cover mode key 67 is detected (S103; YES), if neither the cover mode 1 nor the cover mode 2 has been set (S105; NO, and S107; NO), then the cover mode 1 is set and the LED 120 displaying the cover mode 1 is turned on (S113). The LED indicating the paper feed port in which a paper feed cassette for the cover has been inserted is turned on (S115).

On the other hand, if a cassette for the cover has not been inserted in any of the upper and lower paper feed ports, the LED 112 for the manual paper feed port is turned on. If a cassette for the cover has been inserted in each of the upper and lower paper feed ports, the upper paper feed display LED 113 is turned on.

In addition, in the above, the steps S113 and S115 are for the processing which is executed on the following conditions:

a) No cassette for the cover has been inserted in a paper feed port which is set as a paper feed port for copy paper sheets for documents other than the cover document (S109; NO), or b) If said paper feed port has a cassette for the cover inserted therein, the automatic paper selection mode has been set (S109; YES, and S111; YES).

In other words, in the case where a cassette for the cover has been set in a paper feed port which has been set as a paper feed port for copy paper sheets for documents other than the cover document (S109; YES) and where automatic paper selection mode has not been selected (Slll; NO), the input provided by the cover mode key 67 is neglected and the setting of the cover mode 1 is inhibited.

<ii>Setting of Cover Mode 2

When on-edge provided by the cover mode key 67 is detected (S103; YES), if the cover set mode 1 has been set (S105; YES), the cover mode 2 is set in the manner described below.

First, it is determined whether the developing unit set for development for documents other than the cover document is the upper developing unit 7*a* or the lower developing unit 7*b* (S121).

As a result, if it is found that the lower developing unit 7*b* has been set (S121; YES), the cover mode 2 associated with the upper developing unit 7*a* is set.

That is, on the conditions that the upper developing unit 7*a* has been set in the predetermined position (S123; YES) and that the developing color for the upper developing unit 7*a* differs from that for the lower developing unit 7*b* (S125; YES), the cover mode 1 is cancelled and instead the cover mode 2 is set (S127). Further, the LED for indicating the color corresponding to the color code for the toner in the upper developing unit 7*a* is turned on (S129), and the toner color code for the developing unit 7*a* is stored as a copy color for the cover in the cover color code variable areas of the RAM 213 (S131).

On the other hand, if it is decided at said step S121 that the developing unit 7*a* has been set (S121; NO), then the cover mode 2 using the lower developing unit 7*b* is set.

That is, on the conditions that the lower developing unit 7*b* has been set in the predetermined position (S133; YES) and that the developing color for the upper developing unit 7*a* differs from that for the lower developing unit 7*b* (S135; YES), the cover mode 1 is cancelled and instead the cover mode 2 is set (S137). Further, the LED for indicating the color corresponding to the color code for the toner in the lower developing unit 7*b* is turned on (S139), and the toner color code for the developing unit 7*b* is stored as a copy color for the cover in the cover color code variable areas of the RAM 213 (S141).

<iii> Cancellation of Cover Modes 1 and 2

When on-edge provided by the cover mode key 67 is detected (S103; YES}, if the cover mode 2 has been set (S105; NO, and S107; YES), the cover mode is canceled.

That is, the LED 120 for indicating the cover mode 1 and the LED for indicating the cover mode 2 are turned off (S151) and the color indicating LED corresponding to the color code stored as the developing color for the cover is turned off (see the steps of S153/S131, 141 and color selection key processing routine). Further, the flag indicating that the cover is being copied is reset (S155).

(3) Color Selection Key Processing: S17

Figure 6A:
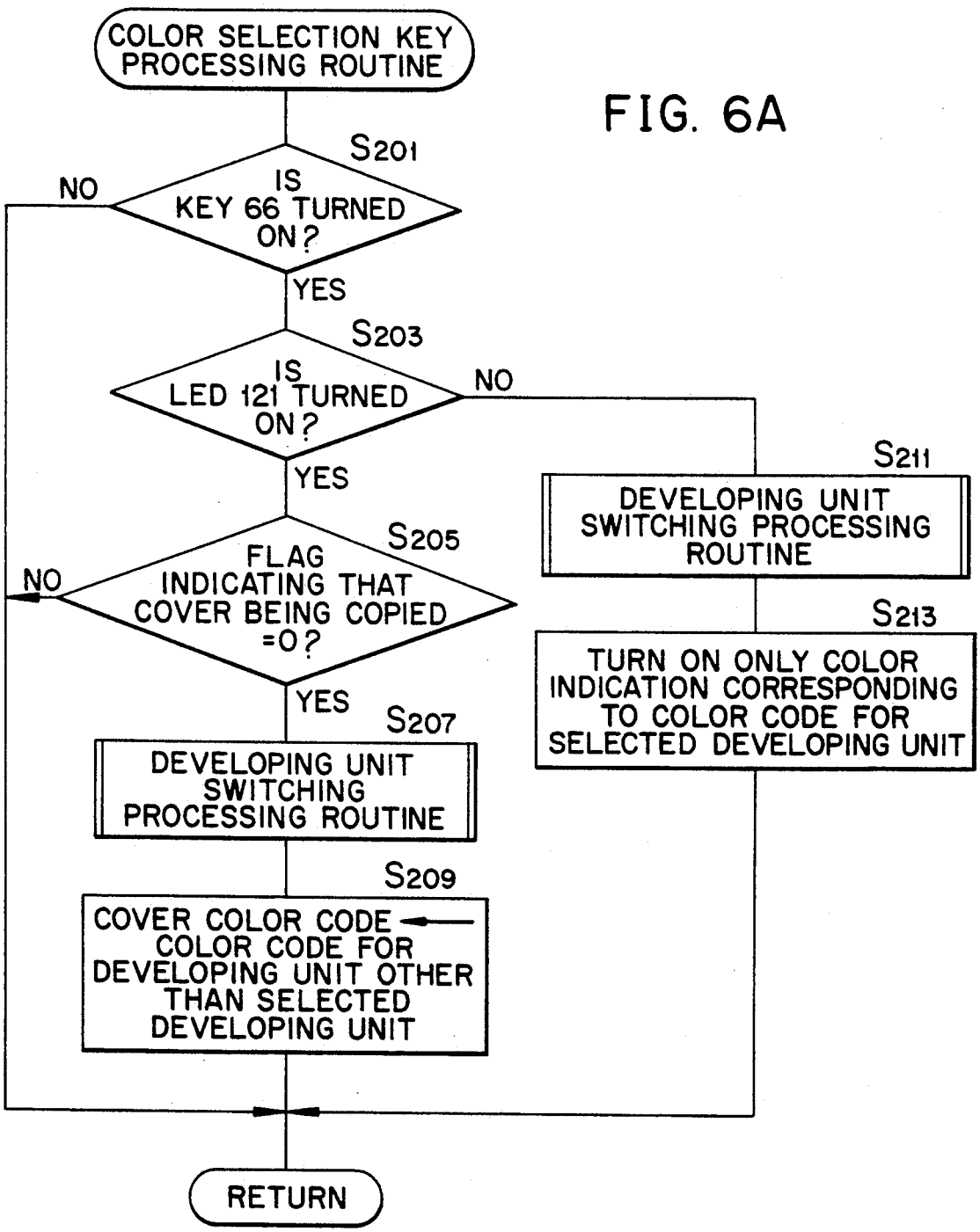
FIG. 6A is a flowchart showing the contents of a color selection key processing routine in FIG. 4.
Figure 6B:
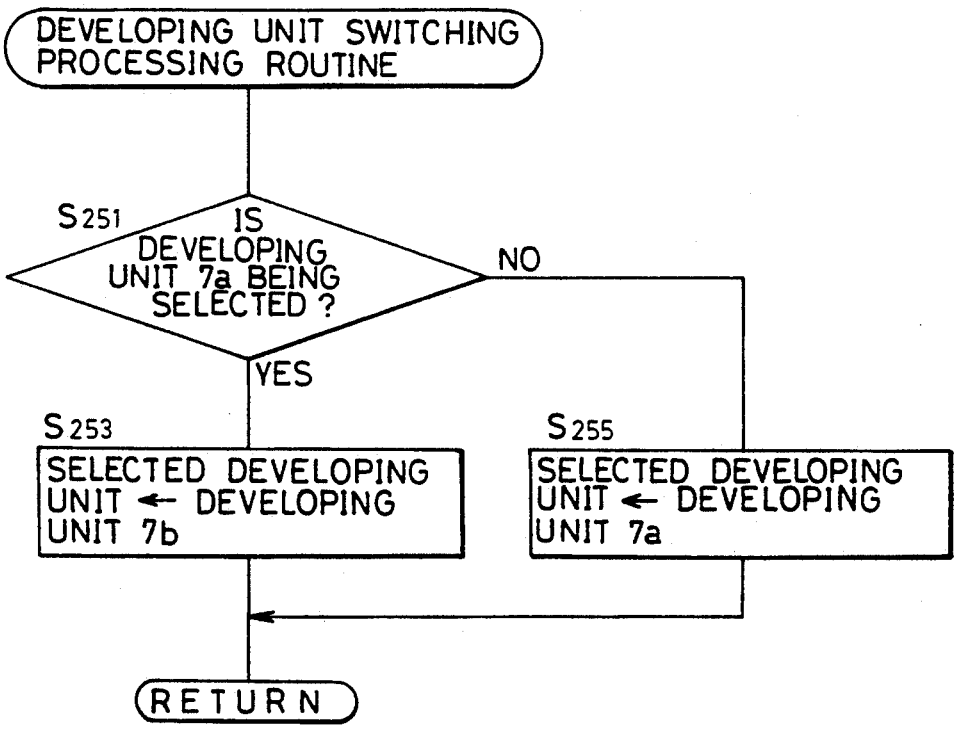
FIG. 6B is a flowchart showing the contents of a developing device switching processing routine in FIG. 6A.

FIG. 6 is a flowchart showing the processing at said step S17.

In this processing, the switching between the developing units for copy processing is effected in response to on-edge provided by the color selection key 66 (S201; YES).

When on-edge provided by the color selection key 66 is detected (S201; YES), first, at the step S203 it is decided whether or not the cover mode 2 has been set.

As a result, if it is found that at the time of on-edge (201; YES) provided by the color selection key 66, the cover mode 2 is set (S203; YES), then the developing unit switching processing routine is executed (S207) on the condition that the flag indicating the cover is being copied is reset, or, in other words, that the cover is not being copied (S205; YES). That is, in the case where at present the upper developing unit 7*a* has been set (S251; YES), the lower developing unit 7*b* is set as a developing unit for documents other than the cover document (S253). If at present the lower developing unit 7*b* has been set (S251; NO), the upper developing unit 7*a* is set (S253).

Thereafter, the color code for the developing unit which has not been set in the developing unit switching processing routine (S207) is stored in the cover color code variable area of the RAM 213, (S209).

Thus, if the color selection key 66 is operated when the cover document is not being copied, the switching of the developing unit is effected.

On the other hand, if it is decided at said step S203 that the cover mode 2 has not been set (S203; NO), then the developing unit switching processing routine is executed (211) in the same manner as at the step S207, so that only the color indicating LED corresponding to the color code for the developing unit which is set at said step S211 is turned on (S213).

(4) Paper Feed Port Selection Key Processing: S19

Figure 7A:
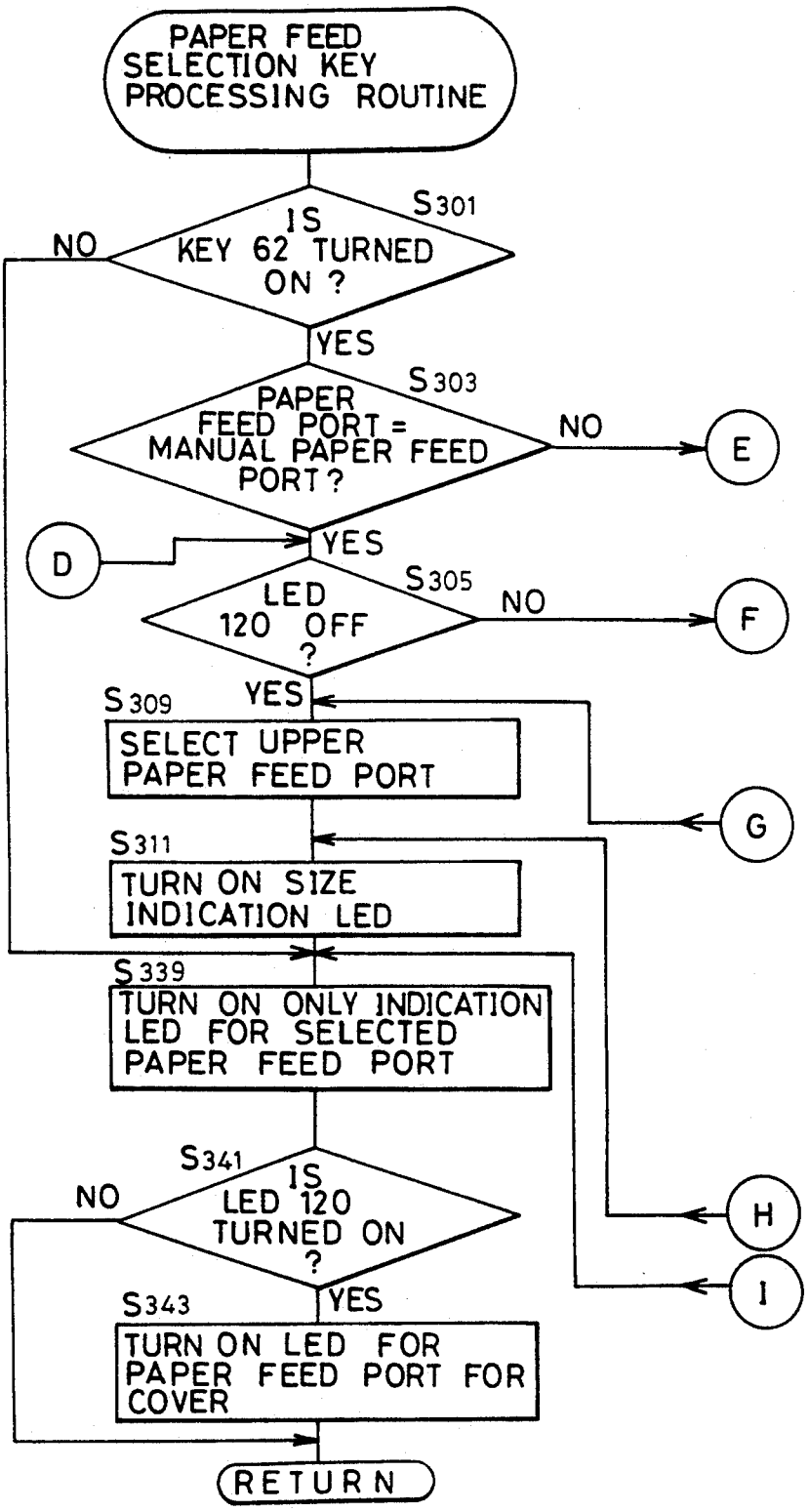
FIGS. 7A, 7B and 7C are flowcharts showing the contents of a paper feed port selection key processing routine in FIG. 4.
Figure 7B:
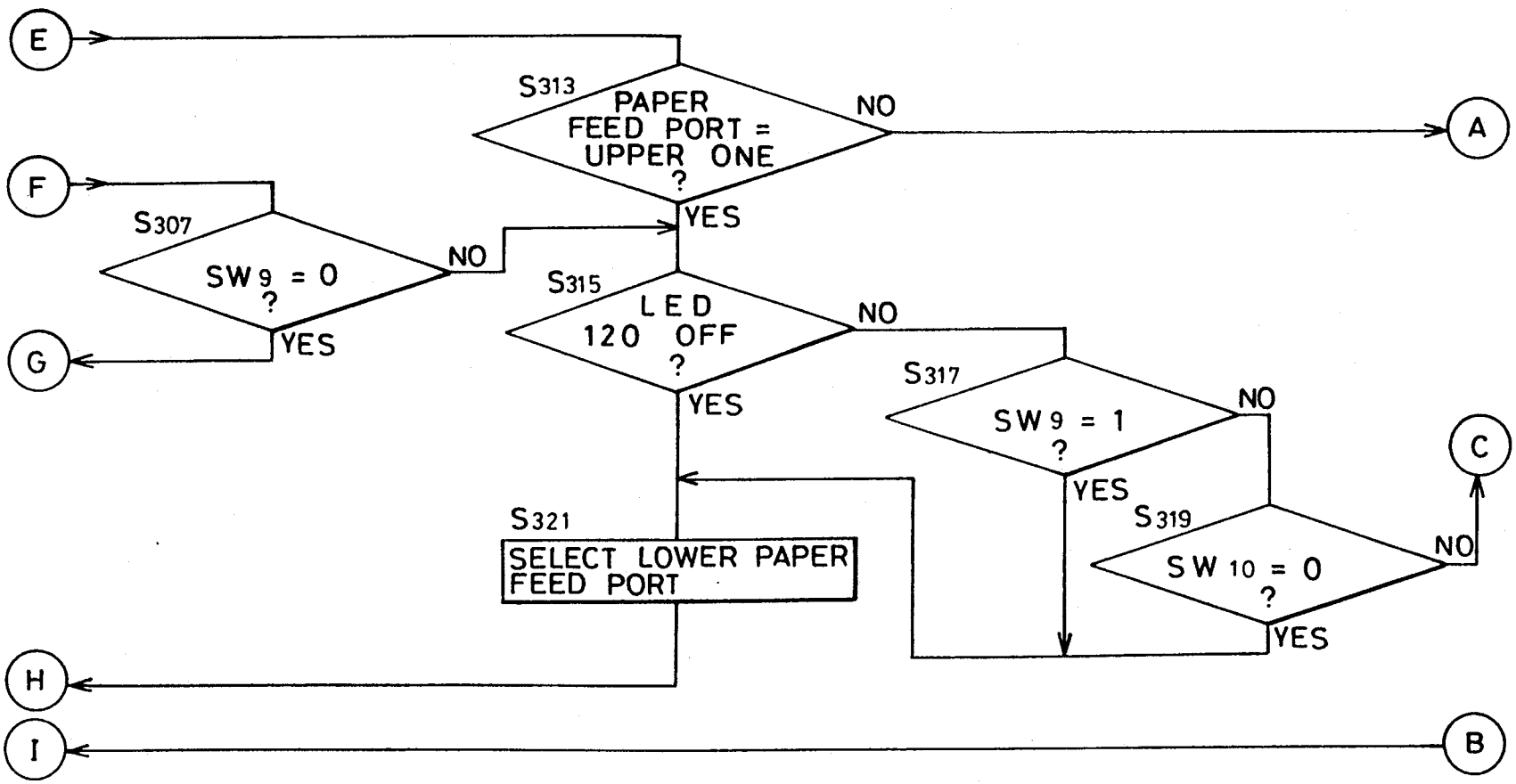
Figure 7C:
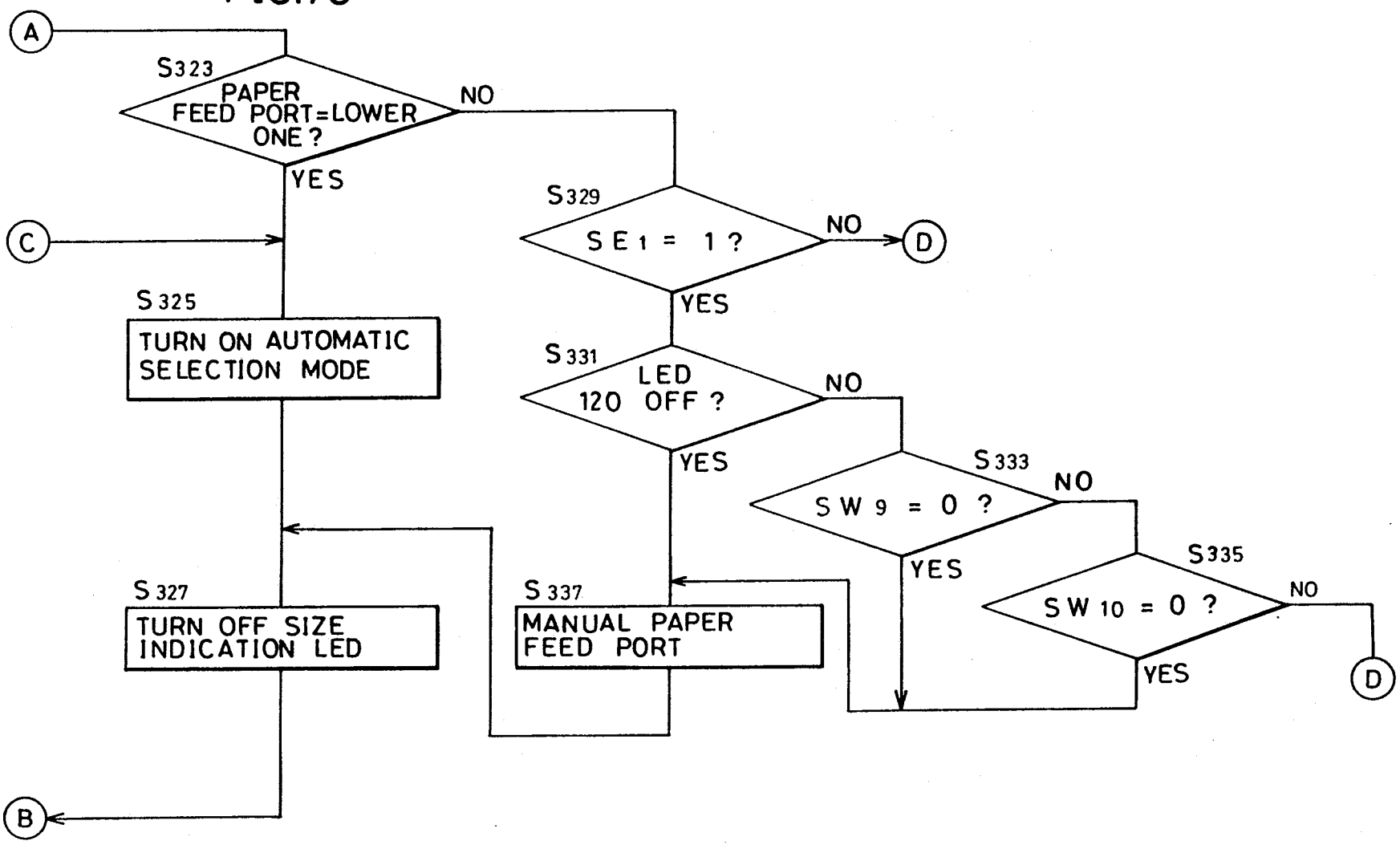

FIG. 7 is a flowchart showing the processing at said step S19.

In this processing, in response to on-edge provided by the paper feed port selection key 62 (S301; YES) and in accordance with the paper feed port which has been set, the switching between the paper feed ports is effected.

<i> Setting of Upper Paper Feed Port

At the time of on-edge provided by the paper feed port selection key 62 (S301; YES), if the manual paper feed port has been set as a paper feed port for the copying of document other than the cover document (S303; YES), the upper paper feed port is set as a paper feed port for the copying of documents other than the cover document (S309). And the size of the paper set in the upper paper feed port is indicated (S311).

However, this is based on the condition that:

a) the cover mode 1 has not been set (S305; YES) or b) even if the cover mode 1 has been set, a paper feeding cassette for the cover has not been inserted in the upper paper feed port (S305; NO, and S307; NO).

In addition, if the cover mode 1 has been set and a paper feeding cassette for the cover has been inserted in the upper paper feed port (S305; NO, and S307; NO), then the program goes to the steps S315 et seq. That is, it goes to the processing for inhibiting the setting of the upper paper feed port and for setting the lower paper feed port under predetermined conditions.

<ii> Setting of Lower Paper Feed Port

When on-edge provided by the paper feed port selection is detected (S301; YES), if the upper paper feed port has been set as a paper feed port for copying documents other than the cover (S313; YES), then the lower paper feed port is set as a paper feed port for copying documents other than the cover (S321). Further, the size of paper set in the lower paper feed port is indicated (S311).

However, this is based on the condition that:

a) the cover mode 1 has not been set (S315; YES), b) even if the cover mode 1 has been set, a cassette for the cover has been inserted in the upper paper feed port (S315; NO, and S317; NO), or c) even if the cover mode 1 has been set, no cassette for the cover has been inserted in any of the upper and lower paper feed ports (S315; NO, and S317; NO and S319; YES).

In addition, if the cover mode 1 has been set and a paper feed cassette for the cover has been inserted in the lower paper feed port (S315; NO and S317; NO and S319; NO), then the program goes to the step S325 and the automatic paper selection mode is set.

<iii> Setting of Automatic Paper Selection Mode

When on-edge provided by the paper feed port selection key 62 is detected (S301; YES), if the lower paper feed port has been set as a paper feed port for copying documents other than the cover document (S323; YES), then the automatic paper selection mode is set (S325). Further, the display of the paper size is turned off (S327).

<iv> Setting of Manual Paper Feed Port

When on-edge provided by the paper feed port selection key 62 is detected (S301; YES), if the automatic paper selection mode has been set or, in other words, if none of the upper, lower and manual paper feed ports have been set as a paper feed port for copying documents other than the cover document (S303; NO, and S313; NO, and S323), then it is first decided whether or not a copy paper sheet has been set in the manual paper feed port. If it is set therein, the manual paper feed port is set as a paper feed port for copying documents other than the cover document (S337). Further, the display of the paper size is turned off (S337).

However, this is based on the condition that:

a) the cover mode 1 has not been set (S331; YES), or b) even if the cover mode 1 has been set (S331; NO), a cassette for the cover has been inserted in either the upper or the lower paper feed port (S333; YES/S333; NO and S335; YES).

In addition, even if the automatic paper selection mode has been set, in the case where a copy paper sheet has not been set in the manual paper feed port (S329; NO), the processing at the steps S305 at seq. is executed.

Further, even if a copy paper sheet has been set in the manual paper feed port (S329; YES), and if the cover mode 1 has been set (S331; YES) and the cassettes in the upper and lower paper feed ports are not cassettes for the cover, then the program goes to the steps S305 et seq, After a paper feed port for copying documents other than tho cover document has been set by the processing described above, only the LED for indicating said paper feed port is turned on (S339).

That is, the following LEDs are lighted.

<i> upper paper feed port→LED 113

<ii> lower paper feed port→LED 114

<iii> automatic paper selection mode→LED 110

<iv> manual paper selection mode→LED 112

Further, if the cover mode 1 has been set (S341; YES), the LED for indicating the paper feed port having a cassette for the cover inserted therein is turned on (S343). In addition, if no cassette has been inserted in any of the upper and lower paper feed ports, the LED 112 for displaying the manual paper feed port is turned on. If cassettes have been inserted in both of the upper and lower paper feed ports, the LED 113 for displaying upper paper feed port is turned on.

(5) Automatic Paper Selection Processing: S21

Figure 8A:
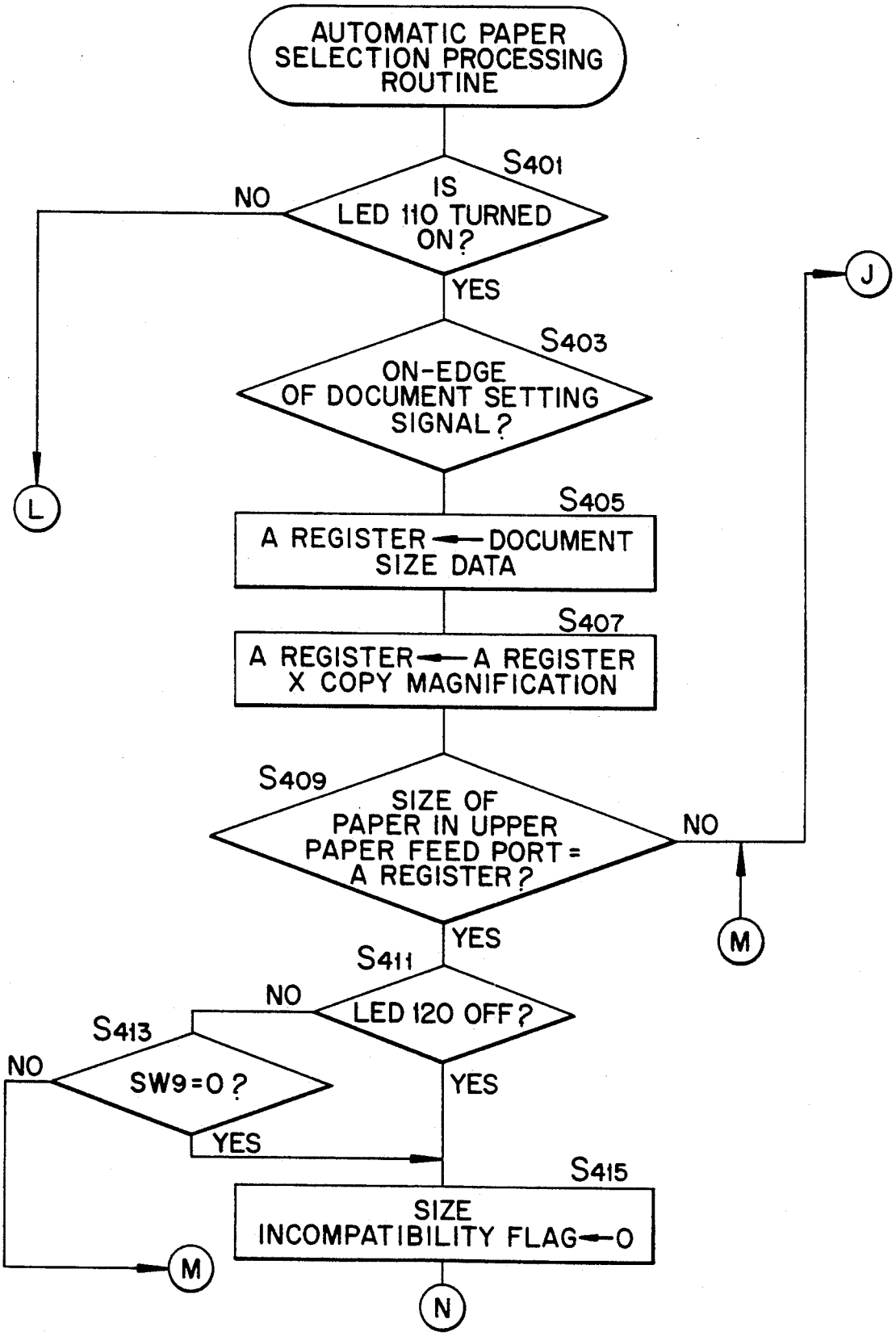
FIGS. 8A, 8B and 8C are flowcharts showing the contents of an automatic paper selection processing routine in FIG. 4.
Figure 8B:
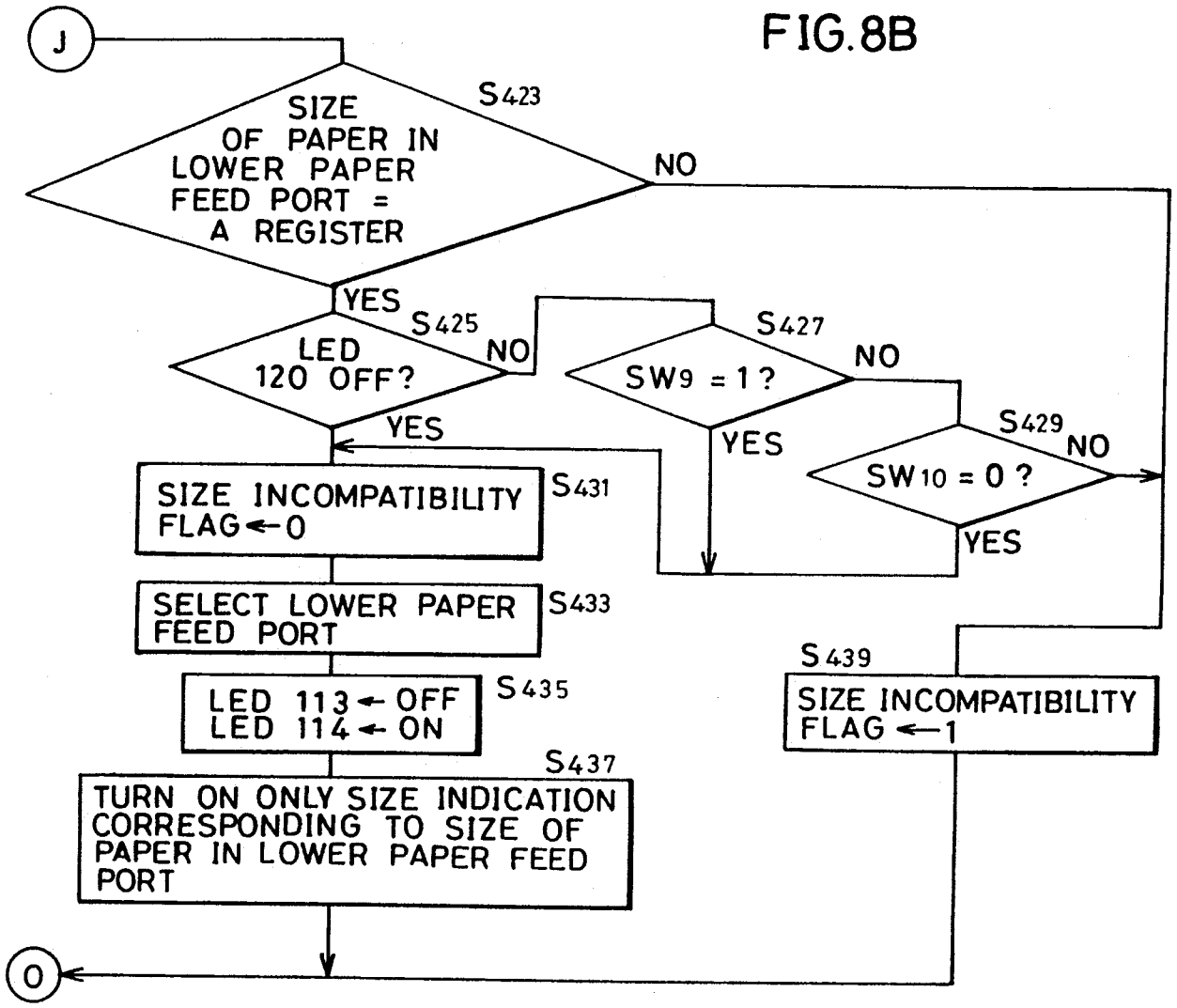
Figure 8C:
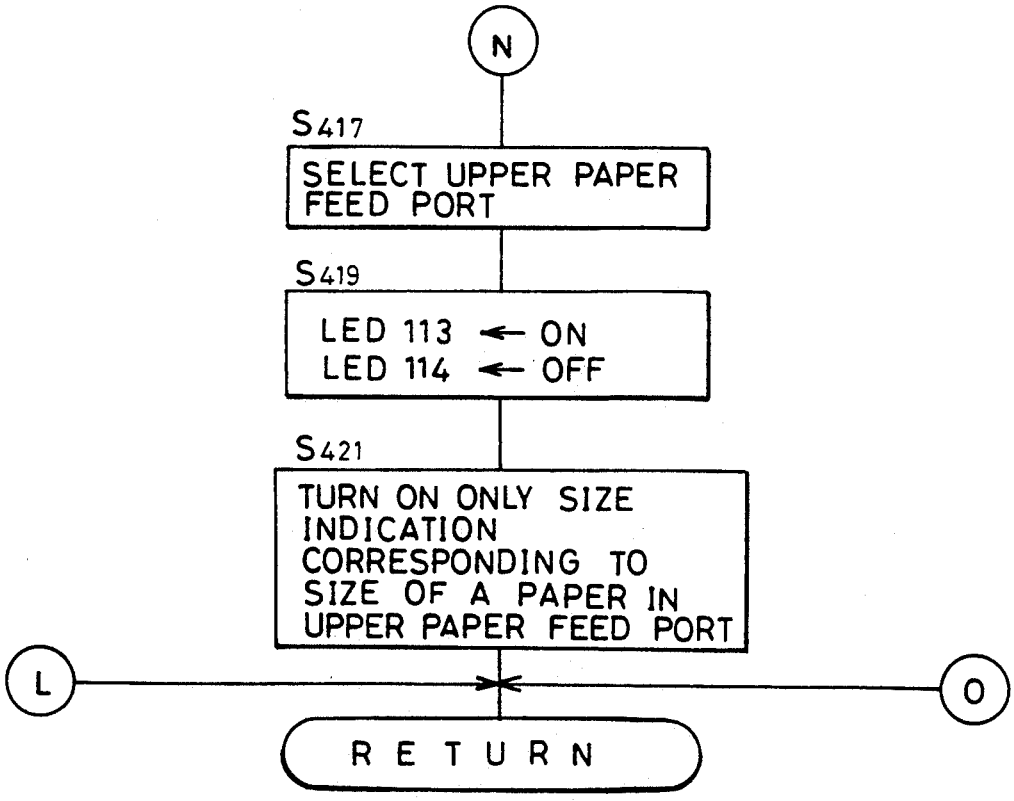

FIG. 8 is a flowchart showing the processing at the step S21.

In this processing, with the automatic paper selection mode being set (S401; YES, see S325 in FIG. 7C), the automatic selection of paper feed ports is selected. And the copy paper feed port for the cover document is prevented from coinciding with the copy paper feed port for documents other than the cover document, in the following manner.

First, in the automatic paper selection mode (S401; YES), when the on-edge of a document setting signal from the CPU3 for ADF control is detected (S403; YES), the document size data are stored in the A register (S405) and the product of said document size data and the copy magnification data is stored in the A register as the size data on the copy paper (S407). In this manner the size of the copy paper required for copying documents other than the cover document is stored in the A register.

Then, the paper size in the A register is compared with the size of the copy paper set in the upper and lower paper feed ports of the present apparatus, and in accordance with the result, the paper feed port for copy paper corresponding to documents other than the cover document is set in the following manner.

<i> Setting of Upper Paper Feed Port

If the size of the copy paper stored in the A register coincides with the size of the copy paper set in the upper paper feed port (S409; YES), the upper paper feed port is set as a paper feed port for copy paper.

That is, the flag indicating size incompatibility is reset (S415), and the upper paper feed port is set as a paper feed port for copy paper (S417). Further, the LED 113 for the upper paper feed port is turned on and the LED 114 for the lower paper feed port is turned off (S419). The LED corresponding to the size code of the copy paper in the upper paper feed port is turned on (S421).

However, this is based on the condition that:

a) the cover mode 1 has not been set (S411; YES), or b) even if the cover mode 1 has been set (S411; NO), no cassette for the cover has been inserted in the upper paper feed port (S413; YES).

In addition, if a cassette for the cover has been inserted in the upper paper feed port with the cover mode 1 being set (S411; NO, and S413; NO), the setting of the upper paper feed port is inhibited and the processing at the steps S423 will be executed.

<ii> Setting of Lower Paper Feed Port

If the size of the copy paper stored in the A register coincides with the size of the copy paper set in the lower paper feed port (S423; YES), the lower paper feed port is set as a paper feed port for copy paper.

That is, the size incompatibility flag is reset (S431), and the lower paper feed port is set as a paper feed port for copy paper (S423) Further, the LED 114 for the lower paper feed port is turned on, and the LED 113 for the upper paper feed port is turned off (S435). Further, the size indicating LED corresponding to the size code of the copy paper in the lower paper feed port is turned on (S437).

However, the steps S431 through S437 are executed on the condition that:

a) the cover mode 1 has not been set (S425; YES), b) even if the cover mode 1 has been set (S425; NO), a cassette for the cover has been inserted in the upper paper feed port (S427; YES), or c) even if the cover mode 1 has been set (S425; NO), no cassette for the cover has been inserted in any of the upper and lower paper feed ports (S427; NO, and S429; YES).

In addition, with the cover mode 1 being set, if a cassette for the cover has been inserted only in the lower paper feed port (S425; NO and S425; NO, and S429; NO), then the size incompatibility flag is reset (S437) and the CPU is returned.

<iii>p0 In the Case of Size Incompatibility

If the size of the copy paper stored in the A register does not coincide with the size of the copy paper set in each of the upper and lower paper feed ports (S409; NO, and S423; NO), the size incompatibility flag is set (S439) in the same manner as in the case of said step of S429; NO.

(6) Mode Cancellation Processing (S439)

Figure 9:
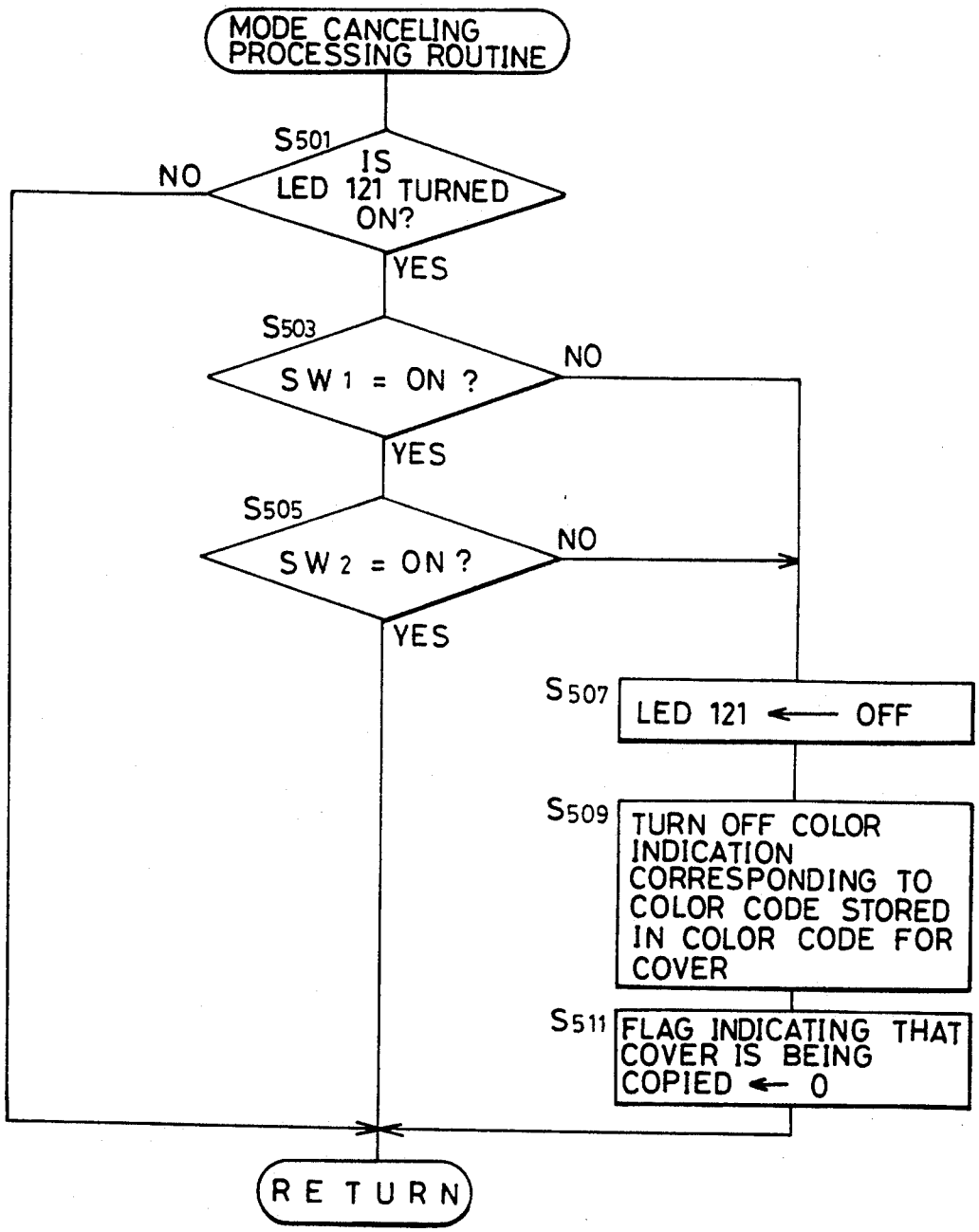
FIG. 9 is a flowchart showing a mode canceling processing routine in FIG. 4.

FIG. 9 is a flowchart showing the processing at the step S23.

This processing is one for cancelling the cover mode 2 when any of the developing units is withdrawn.

That is, with the cover mode 2 being set (S501; YES), if at least one of the upper and lower developing units is not on (S503; NO, or S505; NO), the LED 121 is turned off and the cover mode 2 is cancelled (S507). Further the color indicating LED corresponding to the color code stored in the color code variable area of the RAM 213 (see S131, S141 and S209) is turned off (S509). Further, the flag indicating that the cover is being copied is reset (S511).

(7) Cover Mode Switching Processing: S25

Figure 10:
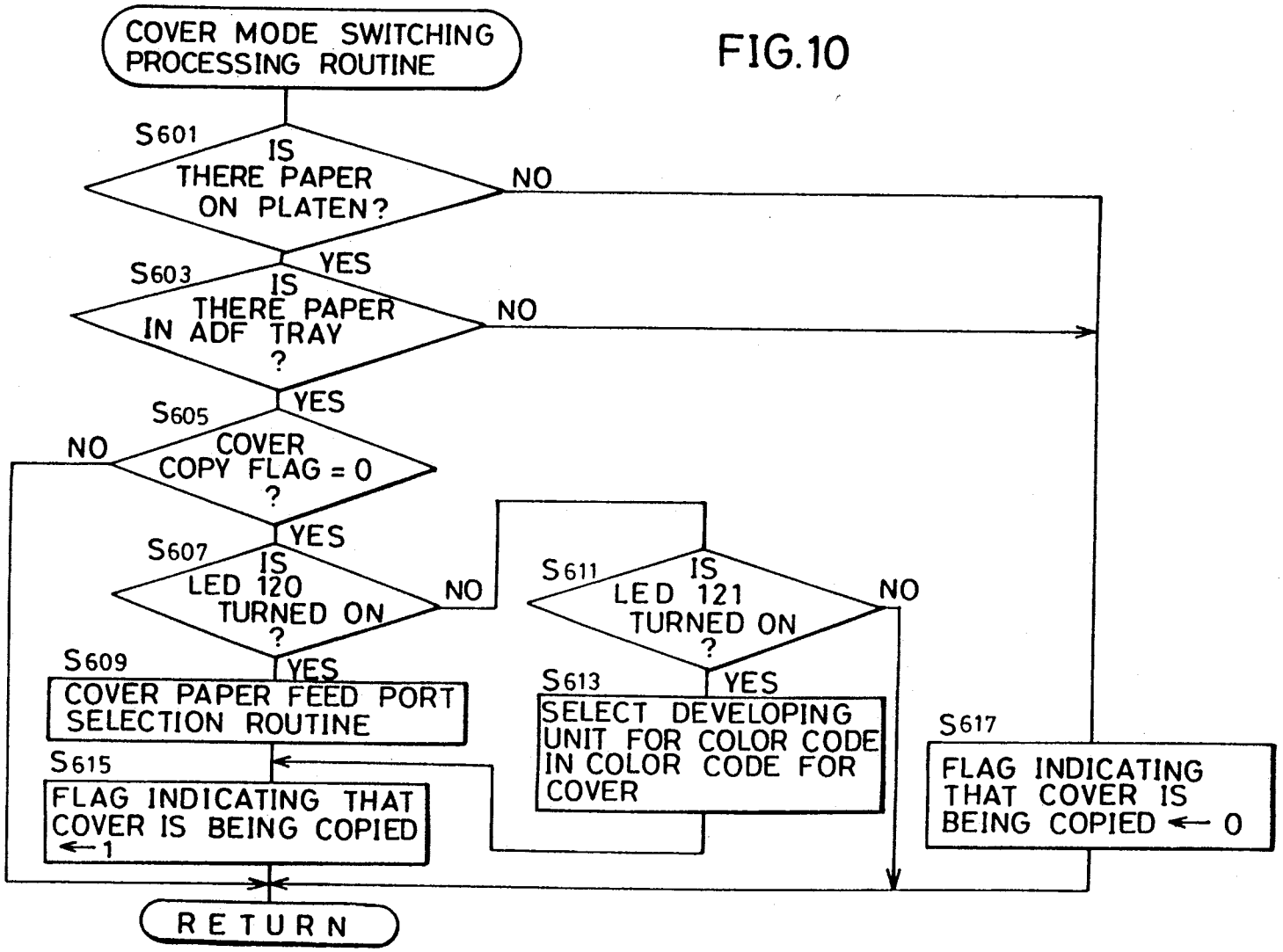
FIG. 10 is a flowchart showing the contents of a cover mode switching processing routine in FIG. 4.

FIG. 10 is a flowchart showing the processing at the step S25.

This processing is one for controlling the switching between cover modes when the original becomes the cover document (the last document).

That is, if there is a document on the platen 11 of the copying machine (S601; YES) and if there is no document on the document tray 304 of the ADF (S603; YES) or, in other words, if the document present on the document table 11 is the cover document (the last document), then the program goes to the step S605 and a decision about the flag indicating that the cover is being copied is made.

As a result, if the flag indicating the cover is being copied has been reset (S605; YES) or, in other words, if the setting processing for the cover document has not been performed yet, then the setting for the cover document is made according to the cover mode which has been set (cover mode 1 or cover mode 2), as described below.

<i> Cover Mode 1

If the cover mode 1 has been set (S607; YES), the routine for selecting a paper feed port for the cover is executed (see S609 FIG. 11) to set a paper feed port for the cover.

Figure 11:
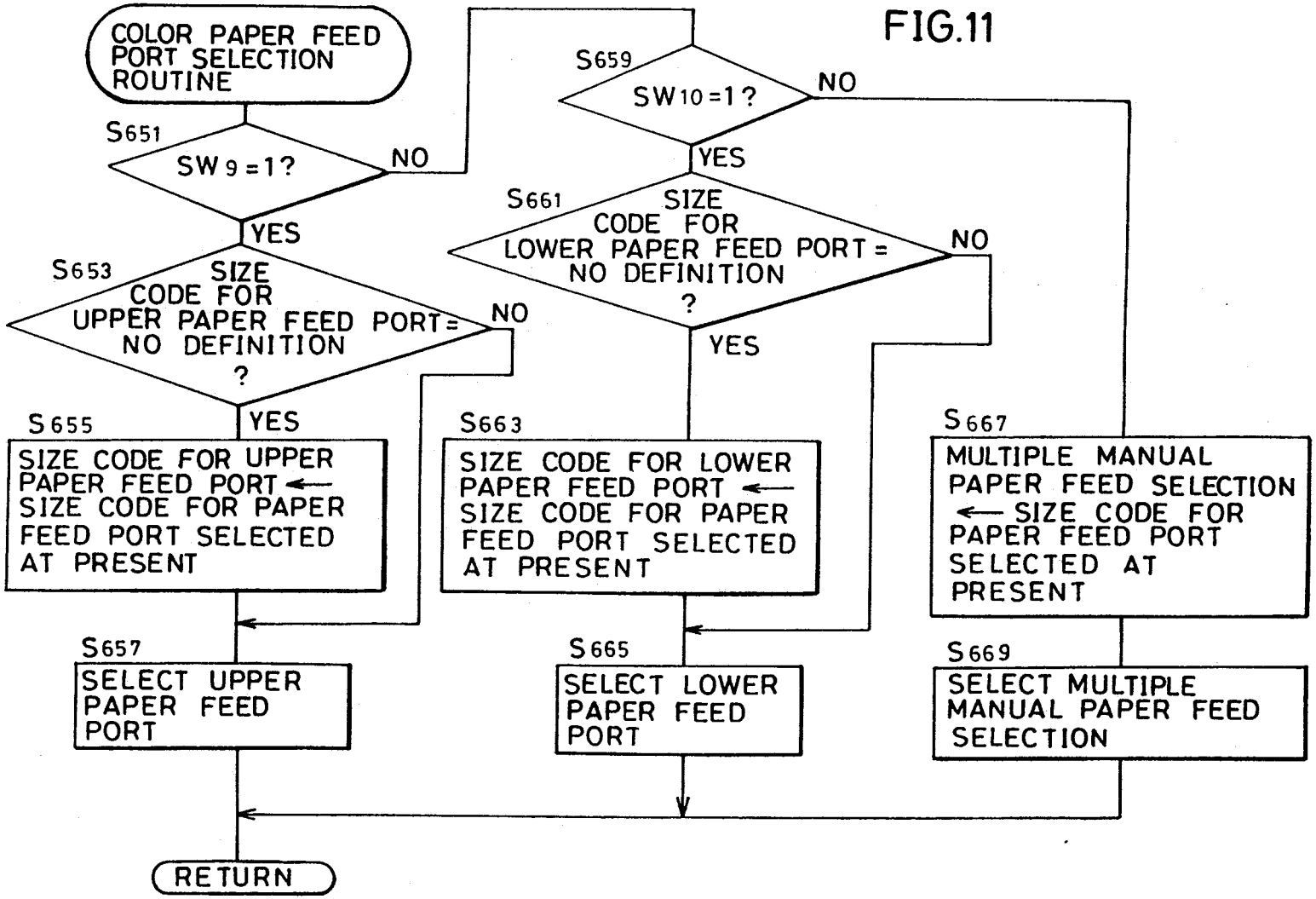
FIG. 11 is a flowchart showing the contents of a cover paper feed port selection routine in FIG. 10.

That is, as shown in FIG. 11:

a) If a cassette for the cover has been set in the upper paper feed port (S651; YES), the upper paper feed port is set as a paper feed port for the cover (S657). In addition, in this case, if the paper size code for the upper paper feed port has not been defined, the presently selected paper size code for the paper feed port (=the paper feed port set for copying documents other than the cover) is set (s655). The reason is that the probability that the size of copy paper for the cover coincides with the size of copy paper for documents other than the cover document is high;

b) If a cassette for the cover has been set in the lower paper feed port (S659; YES), the lower paper feed port is set as a paper feed port for the cover (665). In this case, if the paper size code for the cover has not been defined (S661; YES), the paper size code for the paper feed port (=the paper feed port which was set for copying documents other than the cover) is set (S663).

c) If no cassette for the cover has been set in any of the upper and lower paper feed ports (S651; NO, and S659; NO), the manual paper feed port is set as a paper feed port for the cover. If the paper size code for the manual paper feed part has not been defined, the paper size code for the presently selected paper feed port (=the paper feed port which was set for copying documents other than the cover document) is set for the paper size code for the manual paper feed port (S667)

<ii> Cover Mode 2

If the cover mode 2 has been set (S611; YES), the developing unit for the toner color corresponding to the color code stored in the cover color code variable area of the RAM 213 is set as a developing unit for the cover (S613).

In addition, as is obvious from the above description (S121 through S131; S133 through S141, and S203 through S209), a developing unit which differs from the developing unit used for copying the cover document is set.

After the setting for copying the cover document has been made by the processing described above (the step S609 or S613), the flag indicating that the cover is being copied is set and the program is returned.

In addition, if the flag indicating that the cover is being copied has been set at said step S605 (S605; NO), the program is returned to the main routine since in this case the setting for copying the cover has already been completed.

Further, if the document is not the last document (S601; NO or S601; YES, and S603; NO), the flag indicating that the cover is being copied is reset (S617) and the program is returned.

(8) Copying Processing: S27

Figure 12:
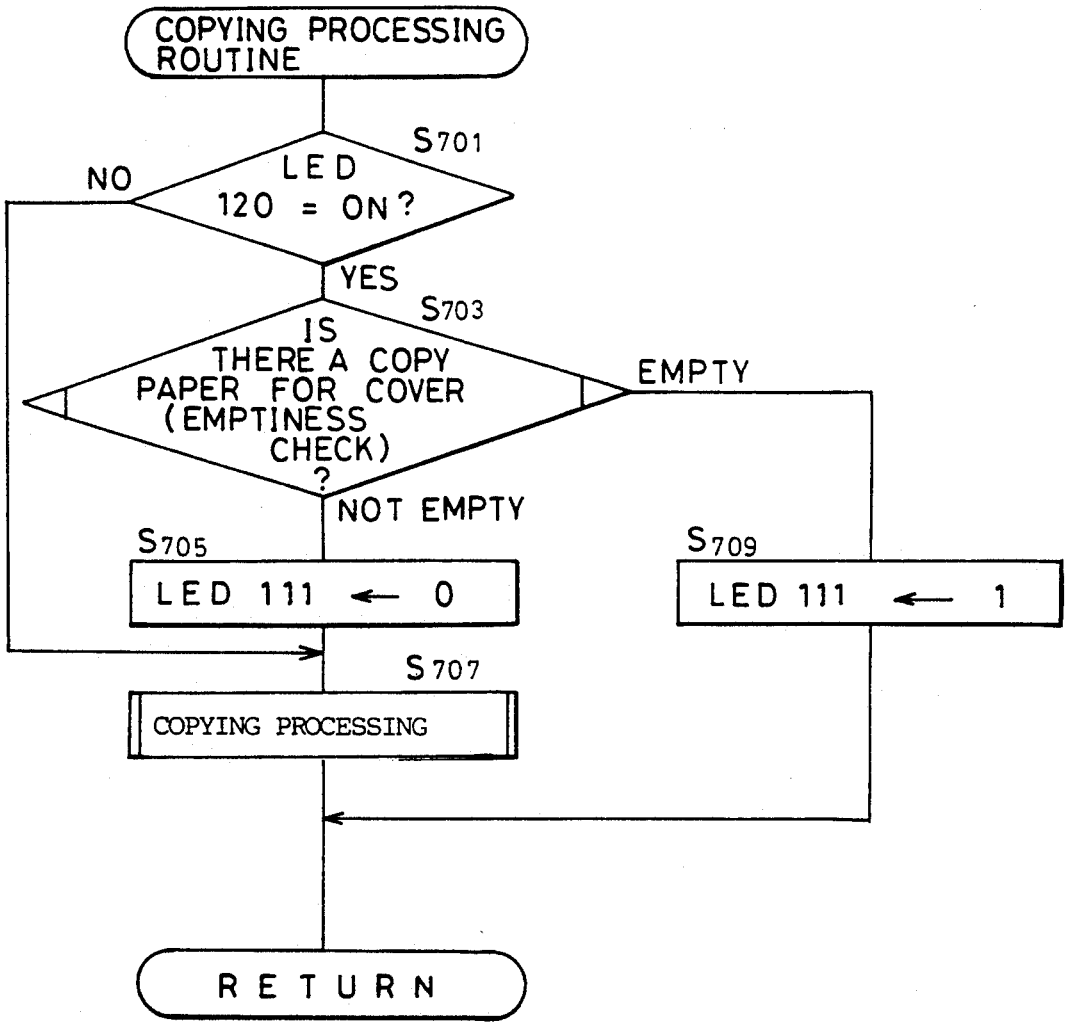
FIG. 12 is a flowchart showing a copy operation processing routine in FIG. 4.

FIG. 12 is a flowchart showing the processing at said step S27.

Figure 13:
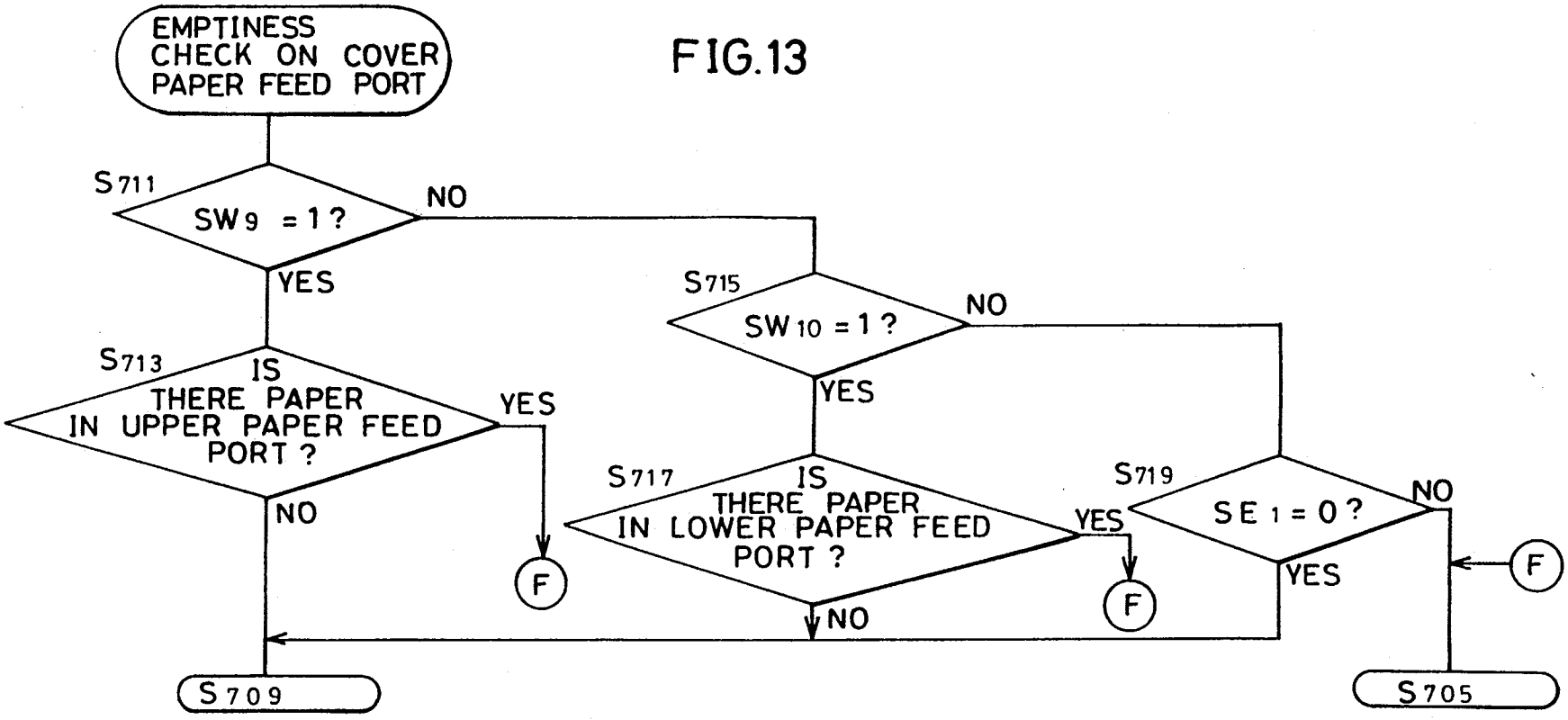
FIG. 13 is a flowchart showing the contents of a cover paper feed port emptiness check processing routine in FIG. 12.

In this processing, first, it is decided whether or not the cover mode 1 has been set. As a result, if it is found that it has been set (S701; YES), emptiness check is made (S703). In this processing, as shown in FIG. 13 it is decided whether or not a copy paper sheet for the cover is present in the paper feed port for copy paper for the cover document.

That is, first, it is decided which paper feed port has been set as a paper feed port for copy paper for the cover document (S711, S715). Then, it is decided whether or not copy paper has been set in the paper feed port set for the cover (S713, S717, S719).

As a result of the above decision, if it is found that no paper has been set in the paper feed port set for the cover (S713/S717/S719; YES), the LED which indicated paper emptiness is lighted (S709) and the CPU is returned. That is, in this case, the copying processing is not executed.

On the other hand, as a result of said decision, if it is found that copy paper has been set in the paper feed port which has been set for the cover (S713/S717/S719; NO), the LED 111 is turned off (S705) and then the copying processing is executed (S707).

In addition, if the cover mode 1 has not been set (S701; NO), the copying processing is executed without making said decision (S707).

Control of the copying machine according to the invention is performed in the manner described above.

As described in the foregoing embodiment, the present invention is a copying machine comprising document feeding means, means for distinguishing between a cover document and other documents, a plurality of developing means to provide different develop colors, and means for selecting developing means according to whether or not a document is the cover document.

As described in the embodiment, according to the invention, different developing means are selected according to whether a document fed to the document table (platen) is the cover or other document.

Therefore, the cover and other documents are copied automatically in different colors or on copy paper sheets of different colors.

Further, the setting of such cover mode can be easily made.

In addition, in the above embodiment, the last document has been decided to be the cover document; however, different developing means may be employed by deciding that the first document is the cover document.

Further, even in a special case in which the cover document is neither the first document nor the last document but is interposed therebetween, the concept of the invention can still be applied. That is, in that case, the number of tho position of the cover document among a series of documents is inputted and the cover document is distinguished on the basis of the input value.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:

original transporting means for transporting a plurality of originals set on a tray one by one to a platen;

a plurality of developing units containing toner;

means for determining whether each color of the toner provided in the developing units is different from each other;

copying mode selecting means for selecting either a first copying mode in which a copy of all of the originals transported by said original transporting means is made by one of said developing units, or a second copying mode in which a copy of a particular original among said plurality of original is made by one of said developing units and a copy of the remaining originals is made by the other developing units; and mean for executing control so that a copying operation of said second copying mode is permitted when said determining means determines that each color of the developing units is different from each other, and so that the copying operation of said second copying mode is prevented when said determining means determines that each color of the developing units is the same as each other.

2. An image forming apparatus comprising:

a main body;

original transporting means for transporting a plurality of original set on a tray one by one to a platen;

a plurality of sheet storing means removable attached to the main body of the apparatus;

means for feeding sheets stored in said sheet storing means;

manual paper feeding means for manually feeding paper;

means for determining a color of sheets stored in said storing means attached to said main body;

copy mode selecting means for selecting either a first copying mode in which a copy of all of the originals transported by said original transporting means is made using sheets of a first color, or a second copying mode in which a copy of a particular original among said plurality of original is made using a sheet of a second color and a copy of the remaining originals is made using sheets of said first color, detecting means for detecting whether said sheet storing means is attached to a predetermined position of the main body; and means for executing control so that a sheet is fed from said sheet storing means when it is detected that a sheet of a different kind in color is provided, a sheet is fed from a manual paper feed means when it is not detected that a sheet of different kind in color is provided, when said copying mode is selected.

3. An image forming apparatus comprising:

original transporting means for transporting a plurality of originals set on a tray one by one to a platen;

sheet feeding means having a plurality of feeding portions for feeding different types of sheets;

a manual inserting portion of manually inserting sheets and feeding the manually inserted sheets;

original distinguishing means for distinguishing a particular one of said originals based on an ordinal position of the one relative to all the other originals;

sheet determining means for determining the type of sheets stored in said feeding portions and in distinguishing which feeding portions is stored a particular type of sheets for said particular original;

control means for switching said feeding portions so that the particular original is copied on said particular type of sheet fed from the distinguished feeding portion and the other originals are copied on sheets other than the particular type of sheets; and means for feeding the sheets manually inserted to said manual inserting portion for the copy of the particular original when said sheet determining means determines an absence of the particular type of sheets stored in the feeding portions.

4. An image forming apparatus according to claim 3, further comprising means for indicating the manual insertion portion for instructing an operator to insert the particular type of sheet when said sheet determining means determines an absence of the particular type of sheets.

5. An image forming apparatus comprising:

original transporting means for transporting a plurality of original set on a tray one by one to a platen;

sheet feeding means having a plurality to feeding portions of feeding different types of sheets;

manual inserting portion for manually inserting sheets and feeding the manually inserted sheets;

original distinguishing means for distinguishing a particular one of said originals based on an ordinal position of the one original relative to all the other originals; and control means for controlling sheet feeding so that the particular original is copied on the sheet fed from said manual inserting portion and the the originals are copied on the sheets fed from one of said feeding portions.

6. An image forming apparatus comprising:

a main body;

original transporting means for transporting a plurality of originals set on a tray one by one to a platen;

a plurality of developing units containing developer at least one of which is removable attached to the main body of the apparatus;

detecting means for detecting a detachment of said developing unit from the main body;

original distinguishing means for distinguishing a particular one of said originals based on an ordinal position of the one relative to all the other originals control means for energizing one of said developing units for copying the particular original and energizing another developing unit for the other originals to copy the particular original in a different color from a color of the other originals; and means for preventing a copying operation when said detecting means detects the detachment.

7. An image forming apparats comprising:

means for providing images of plural pages;

determining means for determining a particular page of said plural pages from the other pages;

sheet feeding means having a plurality of feeding portions for feeding different types of sheets;

a manual inserting portion for manually inserting sheet sand feeding the manually inserted sheets;

distinguishing means for distinguishing in which feeding portion is stored particular sheets for said particular page;

control means for switching said feeding portions so that the image of the particular page is formed on said particular sheet fed from the distinguished feeding portion and the images of the other pages are formed on sheets other than the particular sheet; and means for feeding sheets manually inserted to said manual inserting portion for forming the image of the particular page when said distinguishing means determines an absence of particular sheets in the sheet feeding means.

8. An image forming apparatus according to claim 7, further comprising means for indicating the manual insertion portion for instructing an operator to insert the particular sheet when said sheet determining means determines the absence of particular sheets.

9. An image forming apparatus comprising:

means for providing image of plural pages;

distinguishing means for distinguishing a particular page of said plural pages from the other pages;

sheet feeding mean shaving a plurality of feeding portions for feeding different types of sheets;

a manual inserting portion for manually inserting sheets and feeding the manually inserted sheets; and control means for controlling sheet feeding so that an image of the particular page is formed on a sheet fed from said manual inserting portion and images of the other pages are formed on sheets fed from one of said feeding portions.

10. An image forming apparatus comprising:

means for providing image of plural pages;

distinguishing means for distinguishing a particular page of said plural pages from the other pages;

a plurality of developing units containing developer, at least one of which is removable attached to the main body of the apparatus;

detecting means for detecting a detachment of said one developing unit from the main body;

control means for energizing one of said developing units for forming the image of the particular page and for energizing another developing unit for forming image of the other pages so as to form the image of the particular page in a different color from the color of the images of other pages; and means for preventing image forming operation of said control means when said detecting means detects a detachment.

* * * * *